US008381467B2

(12) United States Patent
Preiss

(10) Patent No.: US 8,381,467 B2
(45) Date of Patent: Feb. 26, 2013

(54) ITEM OF WALL-LIKE STANDING FURNITURE

(75) Inventor: Jürgen Preiss, Raubling (DE)

(73) Assignee: Steelcase Werndl AG, Rosenheim (DE)

( * ) Notice: Subject to any disclaimer, the term of this patent is extended or adjusted under 35 U.S.C. 154(b) by 173 days.

(21) Appl. No.: 13/003,401

(22) PCT Filed: Jun. 4, 2009

(86) PCT No.: PCT/EP2009/004012

§ 371 (c)(1),
(2), (4) Date: Jan. 10, 2011

(87) PCT Pub. No.: WO2010/003490

PCT Pub. Date: Jan. 14, 2010

(65) Prior Publication Data

US 2011/0107696 A1 May 12, 2011

(30) Foreign Application Priority Data

Jul. 10, 2008 (DE) ..... 20 2008 009 270 U

(51) Int. Cl.
*E04B 1/00* (2006.01)

(52) U.S. Cl. ..... 52/281; 52/282.1

(58) Field of Classification Search ..... 52/281, 52/238.1, 239, 242, 282.1, 656.1
See application file for complete search history.

(56) References Cited

U.S. PATENT DOCUMENTS

| | | | |
|---|---|---|---|
| 3,884,002 | A | 5/1975 | Logie |
| 5,076,162 | A | 12/1991 | Goin |
| 6,141,926 | A | 11/2000 | Rossiter et al. |
| 6,389,773 | B1 | 5/2002 | Reuter et al. |
| 6,503,020 | B1 | 1/2003 | Mascioletti et al. |
| 2007/0125016 | A1 | 6/2007 | Yu et al. |

FOREIGN PATENT DOCUMENTS

| | | |
|---|---|---|
| DE | 91 15 210.0 | 12/1991 |
| DE | 296 03 402 | 8/1996 |
| DE | 101 60 740 | 6/2003 |
| EP | 1 050 637 | 10/2004 |
| GB | 1 378 300 | 12/1974 |
| WO | 87/03321 | 6/1987 |

OTHER PUBLICATIONS

International Search Report for PCT/EP2009/004012, mailed Aug. 27, 2009.

*Primary Examiner* — Basil Katcheves
(74) *Attorney, Agent, or Firm* — Nixon & Vanderhye P.C.

(57) ABSTRACT

An item of wall-like standing furniture, in particular in the form of a partition wall, is distinguished, inter alia, by the following features: —a hole (37, 39) is made in a central body section (21), in each case from the outside in the axial direction of the respective insertion limb (23), wherein the two holes (37, 39) intersect in a crossing section (40), —an intermediate anchoring element (43) can be or is inserted, by way of its insertion body (43), into at least one of the two holes (37, 39), the intermediate anchoring element (43) has a threaded hole (45) which rent transverse to the axial direction of the insertion body (43*a*), the intermediate anchoring element (43) can be or is positioned in the at least one hole (37, 39) such that the threaded hole (45) in the insertion body (43*a*) is aligned with the respectively other hole (39, 37) in the central body section (21).

15 Claims, 6 Drawing Sheets

ITEM OF WALL-LIKE STANDING FURNITURE

This application is the U.S. national phase of International Application No. PCT/EP2009/004012, filed 4 Jun. 2009, which designated the U.S. and claims priority to German Application No. 202008009270-1, filed 10 Jul. 2008, the entire contents of each of which are hereby incorporated by reference.

BACKGROUND OF THE INVENTION

The most varied embodiments of partition walls and partition wall units or modules which can be erected in different places in a room, particularly in an open-plan office, are known.

A partition wall element of this type as an example of an item of wall-like standing furniture usually comprises a modular frame, in particular a rectangular modular frame with two vertically extending lateral profile parts which are offset in the horizontal longitudinal direction and at least one upper and one lower connecting or terminal profiled part. The profiled parts which are arranged in the form of a rectangle are connected together at their corner regions by corner elements. Usually provided inside this modular frame is a wall surface element which can be constructed in different ways using a wide variety of materials (also depending on the different purposes of use). Differences also arise in respect of the thickness of a wall surface element of this type, since it is frequently also to be used for acoustic damping.

Wall elements of this type can be erected as individual modules aligned next to one another in the longitudinal direction or oriented at an angle to one another.

However, wall modules of this type are preferably also interlinked to increase stability.

U.S. Pat. No. 3,884,002 discloses, for example a partition wall system in which individual wall panels can be interlinked while extending in the longitudinal direction or transversally to one another. For this purpose, accommodated in an integrated manner into the modular frame in the corner regions are specifically threaded apertures which can be screwed together with transversely extending threaded bolts.

Another example of an item of wall-like standing furniture using a wall module is also known, for example from DE 101 60 740 A1. In this case as well, a rectangular modular frame including associated corner angle pieces is described, the corner angle pieces being provided with projecting plug-in portions which can be inserted with one arm thereof into a corresponding cavity portion of, for example, the upper or lower terminal or connecting profiled part on one side and can be inserted with the other arm into the upper or lower receiving opening in a lateral profiled part on the other side.

It is possible to arrange next to a wall module a subsequent wall module which is connected thereto. For this purpose, so-called connecting blocks are used which can be pushed into the corner angle regions. For connection purposes, screws are used which are screwed into a connecting block of this type in the corner angle pieces from the inside of the frame (i.e. in the plane of the wall element to be inserted later on), it then being possible for a screw in this connecting block to also be screwed in at the same height from the next wall element. However, this is only possible when, in the modular frame, the inter-positioned wall surface element which is used for example for insulation has not yet been inserted.

An angular orientation of wall elements relative to one another is not possible with this system, or is only possible to a very limited extent.

SUMMARY OF THE INVENTION

It is therefore the object of the present invention, starting from the last mentioned generic prior art, to provide an improved item of wall-like standing furniture, in particular in the form of a partition wall module which can be easily linked with further wall elements, thereby providing a pleasing design.

The present invention provides an easy-to-handle connection element for constructing and interlinking items of wall-like standing furniture, in particular partition walls and partition wall systems.

A wall element according to the invention is characterised by corner elements which are not only used for connecting horizontal and vertical beams in corner regions, but which can also be used at any time, as required, for linking with further wall elements.

The high degree of stability is achieved in that, provided in the plug-in arms for connecting to an adjoining horizontal or vertical profiled part of a wall element are axial holes into which screw elements can be inserted in order to rigidly connect the corner element to the respective horizontal or vertical profiled part of a wall element. When used as a single wall element, a cover cap can finally be attached, as a result of which the openings provided below the cap for insertion of the screws are sealed in an outwardly aesthetically pleasing manner.

When interlinking is to be carried out with an adjacent wall element, the corner element according to the invention is characterised in that, inside, it has an intermediate body portion in which a vertical hole and a horizontal hole are made from outside. These vertical and horizontal holes are used first and foremost for inserting the above-mentioned fastening screws which extend in the horizontal and vertical directions, by which the corner element is connected to the horizontal or vertical profiled parts of a wall element. It is then also possible for an intermediate (preferably cylindrical) anchoring element to be inserted therein, for example through the elongated horizontal hole, such that a cross hole made in the intermediate anchoring element aligns with the hole, extending vertically downwards from above, in the intermediate body portion of the corner element. This then makes it possible to attach a rectangular connection element, likewise using screws, on the upper side of the corner element intermediate body portion for a longitudinal interlinking with the next wall.

If two wall elements are to be interlinked while extending in one plane, a rectangular connection member can also be used for this. Since the connection elements thereof are used at an angle of, for example 120° or 90°, a straightforward connection with the next wall element can be achieved in that a connection element at an angle of 120° or 90° is used. In this case, it is also possible in the same way to insert T-shaped connecting plates if, for example a wall element which extends transversely by 90° and a wall element which continues rectilinearly at an angle of 180° are to be assembled together.

However, the connection element can likewise also be used to build a wall-like construction element onto the top of an existing wall portion to increase the overall height of the wall element. In the simplest construction, this produces a high degree of flexibility with a pleasing design.

BRIEF DESCRIPTION OF THE DRAWINGS

In the following, the invention will be described in more detail with reference to drawings. In the drawings.

DETAILED DESCRIPTION OF THE INVENTION

Figure 1:
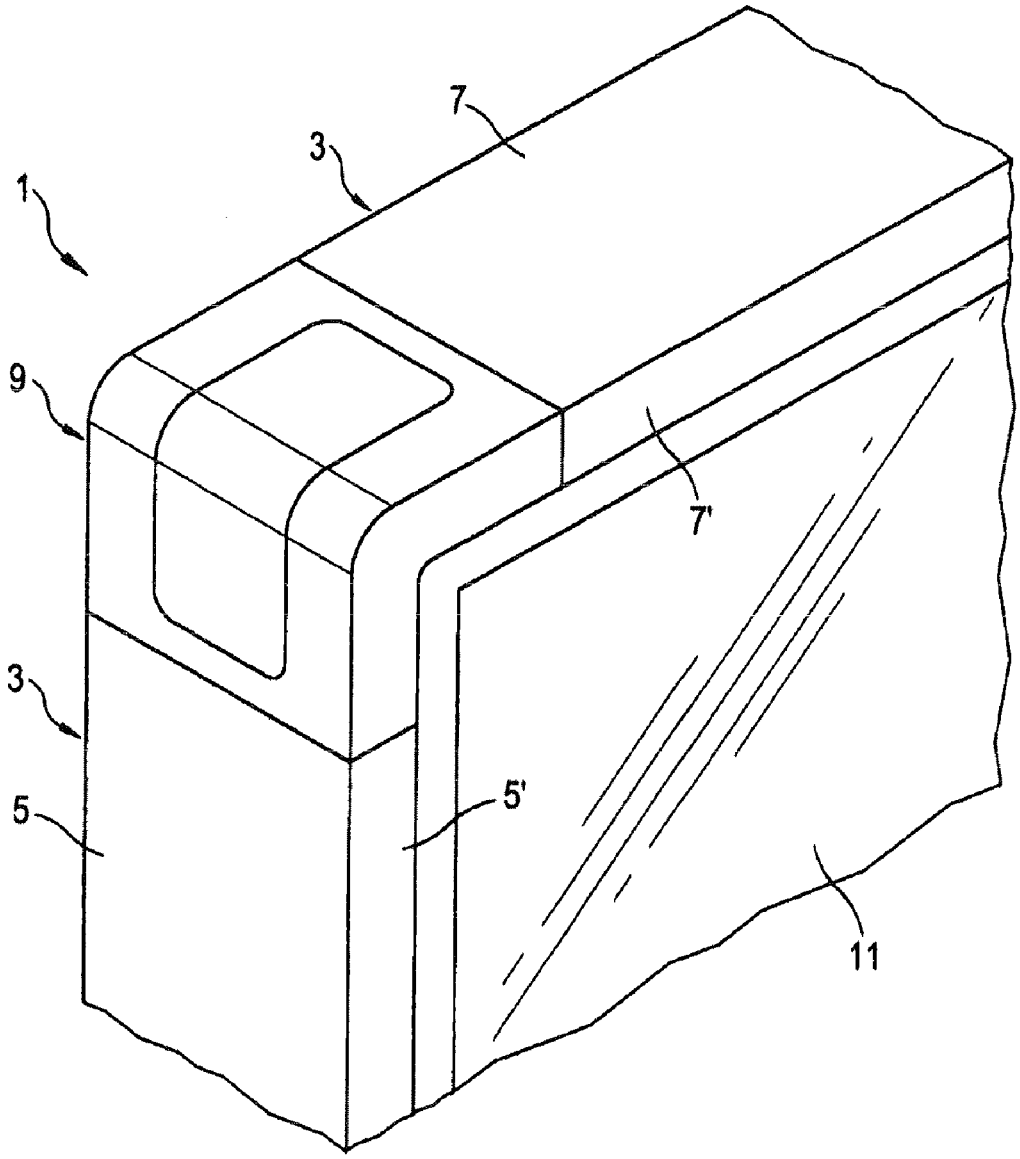
FIG. 1 is a schematic perspective view of a detail of a partition wall according to the invention in the upper left-hand corner region.

FIG. 1 is a perspective view of a detail of an item of wall-like standing furniture 1 according to the invention, which is also abbreviated in the following to partition wall, partition wall element or partition wall module. Partition wall elements of this type can be erected in suitable locations, for example to organise open-plan offices.

A partition wall module of this type comprises a modular frame 3, for example with lateral profiled parts 5 which are arranged on the left-hand side and on the right-hand side, extend vertically in the illustrated embodiment and are thus offset from one another in the horizontal direction, and an upper and a lower terminal or connecting profiled part 7. These two lateral profiled parts 5 and the two connecting profiled parts 7 are connected in the corner regions in each case via a corner element 9 to form a rigid, closed modular frame 3.

Provided inside this modular frame 3 is a wall surface element 11 which can be formed from different materials. This wall construction can also be multi-layered, for example using different materials, in particular to realise optimum acoustic insulation values. In principle, the thickness or depth transversely to the plane of the wall surface element 11 including the associated modular frame and the profiled parts can be selected to have different values.

With reference to FIG. 1, the mentioned corner element 9 can only be seen from outside, as it is employed when a single wall element is used in the manner of a partition wall.

Figure 2:
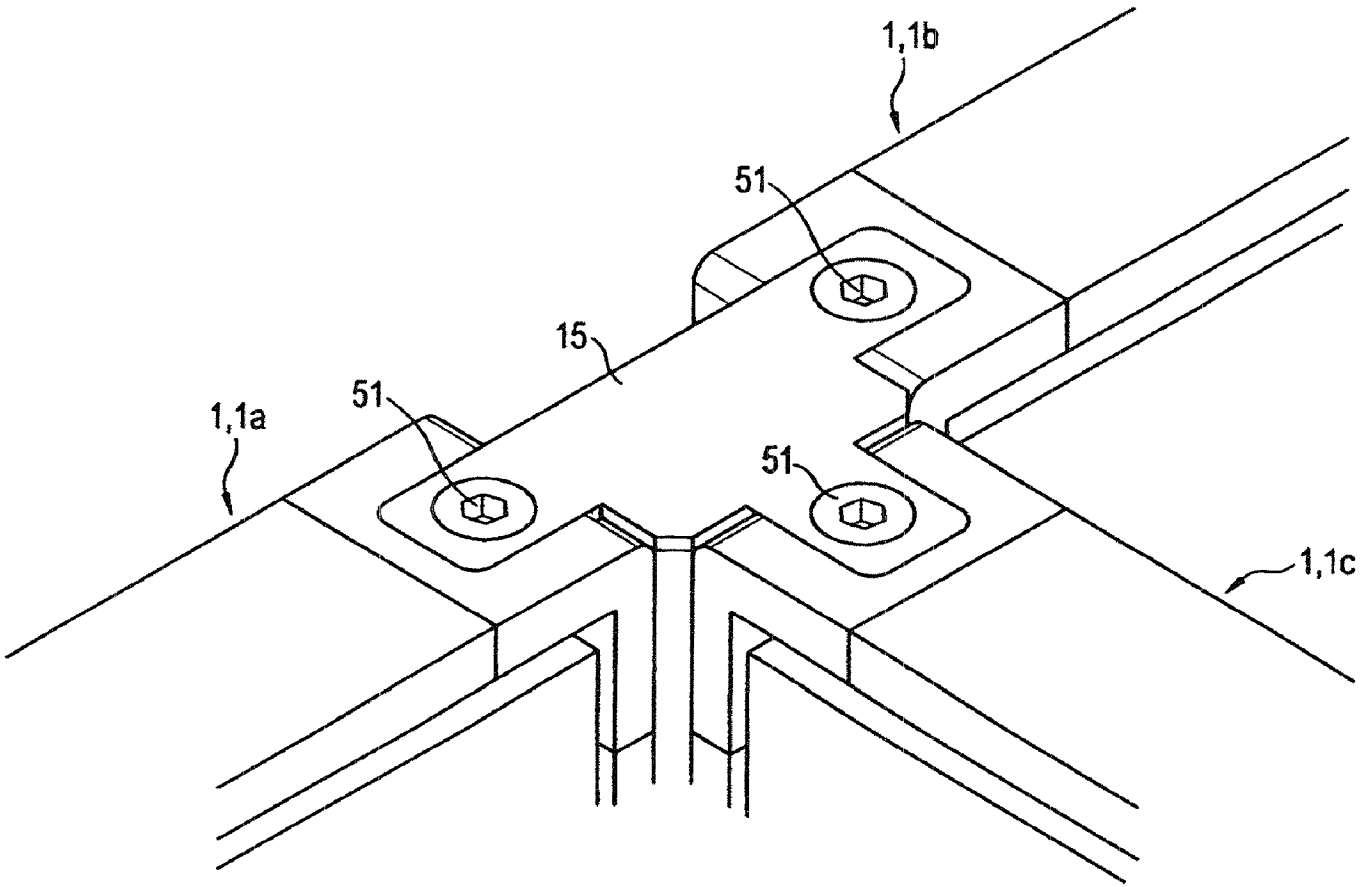
FIG. 2 is a corresponding perspective view with the interlinking of three partition wall elements.

FIG. 2 is a schematic and perspective view of a detail when, for example, three such wall elements are to be interlinked. In this respect, in the embodiment according to FIG. 3, a first wall element 1*a* and a second wall element 1*b* are arranged in an extension of 180° to one another and a third wall element 1*c* is attached perpendicularly thereto. In this case, an upper connection or linking element 15 is screwed on, more specifically on the mentioned corner elements 9, a more precise description of the construction and mode of operation being provided in the following.

Figure 3:
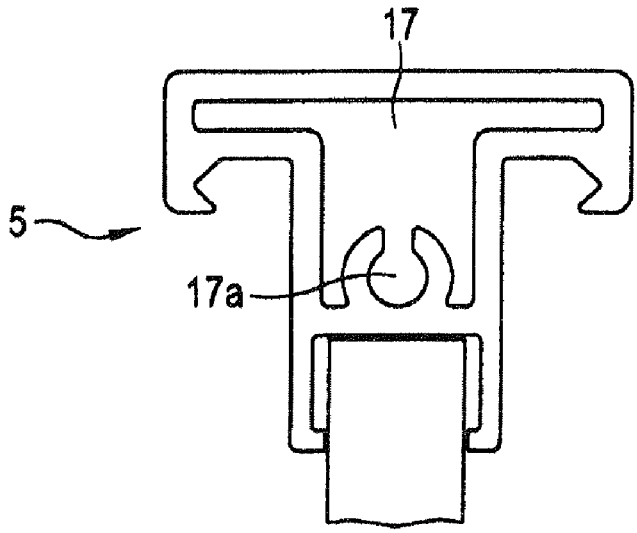
FIG. 3 is a cross-sectional view through a corresponding horizontal or vertical profiled part, which delimits a wall element.

FIG. 3 merely shows a schematic cross section through a lateral profiled part 5 or connecting profiled part 7. This profiled part can vary in configuration. It is preferably produced as a continuous casting, for example from metal, in particular aluminium. In the illustrated embodiment, the cross section of such a lateral and/or connecting profiled part 5, 7 is approximately T-shaped, thus it has a T-shaped inner socket 17 which is also called a plug-in socket 17. Furthermore, provided inside the plug-in socket 17 is also a longitudinally slotted screw channel 17*a*, the significance of which will be explained later on.

The construction and configuration of the corner element will be described more precisely with reference to the following drawings.

Figure 4:
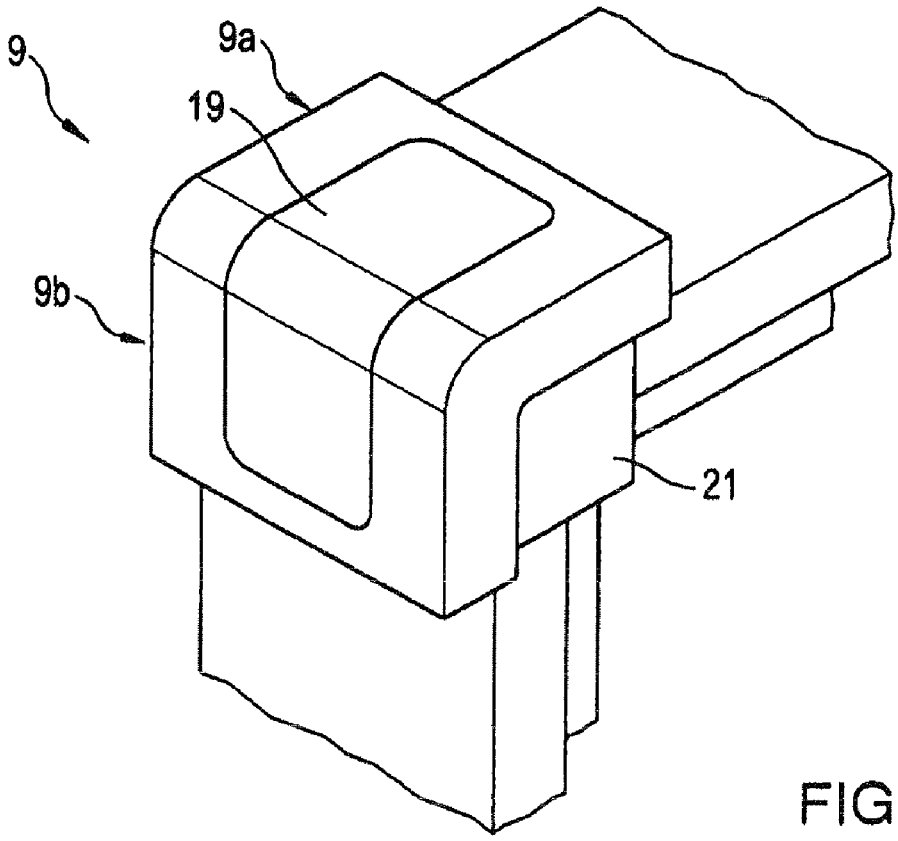
FIG. 4 is a schematic perspective view of the corner element according to the invention with an attached cover cap.

Referring to FIG. 4, the corner element 9 is again shown separately, as it is incorporated in the wall element according to FIG. 1. In this respect, an assembly opening which is made in the corner angle and extends from the first, for example upper corner element portion 9*a* to the corner element portion 9*b* which, in the illustrated embodiment, is offset by 90° and extends vertically, is sealed by a cover cap 19. This cover cap 19 can be removed by a type of catch or click connection or by compressive forces to be applied accordingly.

Figure 5:
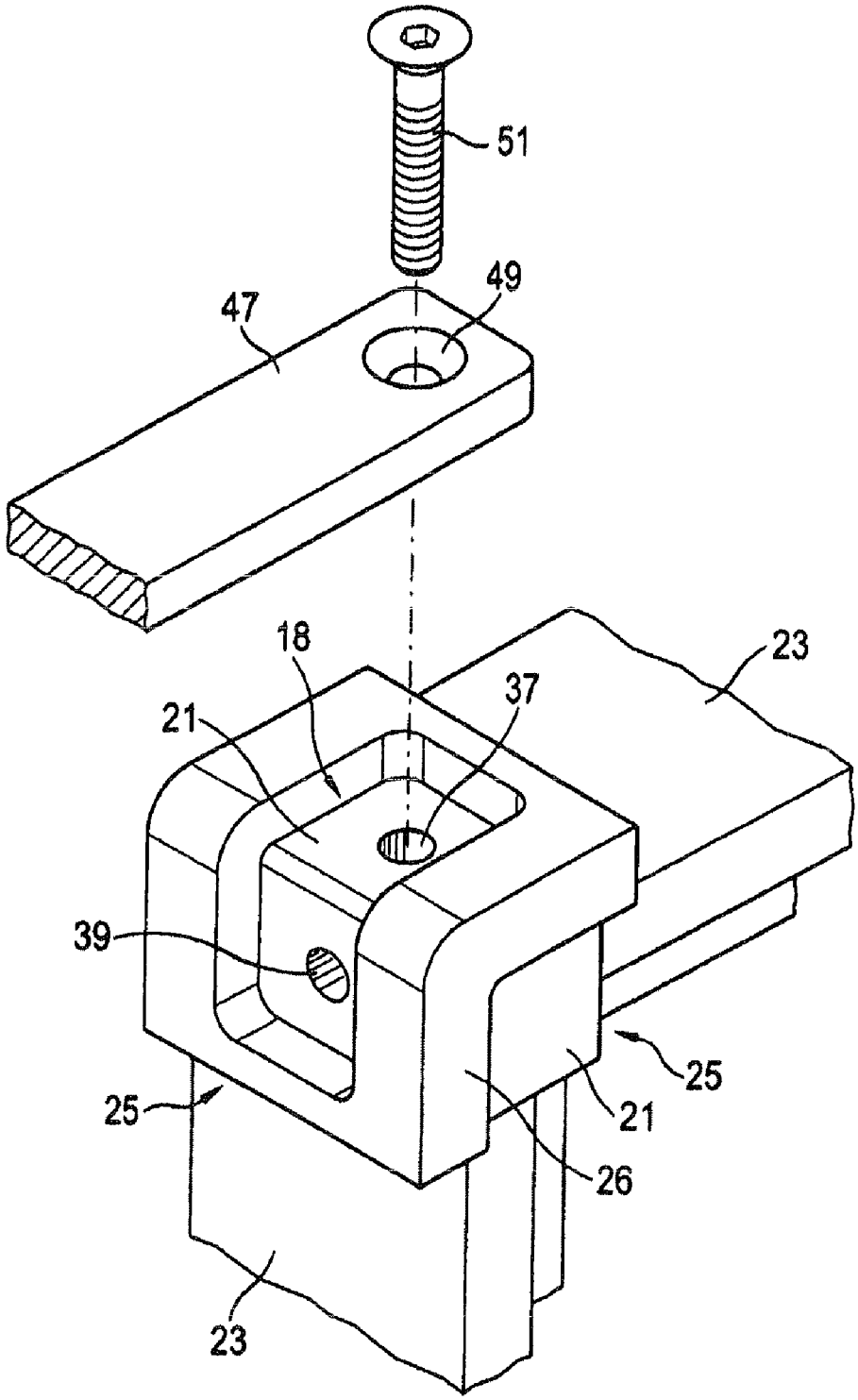
FIG. 5 is a schematic perspective view of the corner element according to the invention without a cover cap.

FIG. 5 schematically shows the corner element according to the invention when the above-mentioned cover cap 19, has been removed. With the cover cap 19 removed, it is now possible to see in the assembly opening 18 a central body portion 21, from which issues a respective plug-in arm 23 which is T-shaped in cross section and which protrudes with relatively small external dimensions on two mounting sides 25 which are offset by 90°. The cross section of the T-shaped plug-in arm 23 is adapted in accordance with the cross-sectional shape of the socket, i.e. of the plug-in socket 17 (FIG. 3) for the lateral profiled parts 5 and the connecting profiled parts 7. If the lateral and connecting profiled parts have a different cross section, the corresponding corner element 9 should also be adapted accordingly in respect of its plug-in arms. Thus, these plug-in arms can be pushed into the respective plug-in socket 17 to connect a lateral profiled part to a terminal or connecting profiled part 5, 7, until the associated mounting side 25 rests against the end-face end of the respective lateral profiled part 5, 7.

The width and height of the central body portion 21 is selected such that the front and rear lateral face, in particular the front and rear lateral face which, in the assembled state, usually extends vertically, merge directly into the lateral faces 5', 7' of the adjoining lateral profiled part 5 and the adjoining terminal or connecting profiled part 7 (FIG. 1).

The further construction of the corner angle in question is illustrated with reference to the further figures.

As emerges in particular from FIG. 5 in a schematic, perspective view and from FIG. 6 in a cross-sectional view, after the cover cap 19 has been removed, the central body portion 21 located below the cover cap 19 can be seen in the corner element under the assembly opening 18, in which central body portion 21*a* first axial hole 37 ends which, in the illustrated embodiment according to FIG. 5 of the insertion opening 37', is made downwards from above (namely in the immediate axial extension of the T-shaped plug-in arm 23 which projects downwards in FIG. 4). In addition, a further axial hole 39 which extends perpendicularly thereto is made in the central body portion 21 and which, in the embodiment according to FIGS. 5 and 6, extends from left to right (i.e. extending in the horizontal direction) from the insertion opening 39' also in the immediate axial extension of the second T-shaped plug-in arm 23 provided in the horizontal direction.

Figure 6:
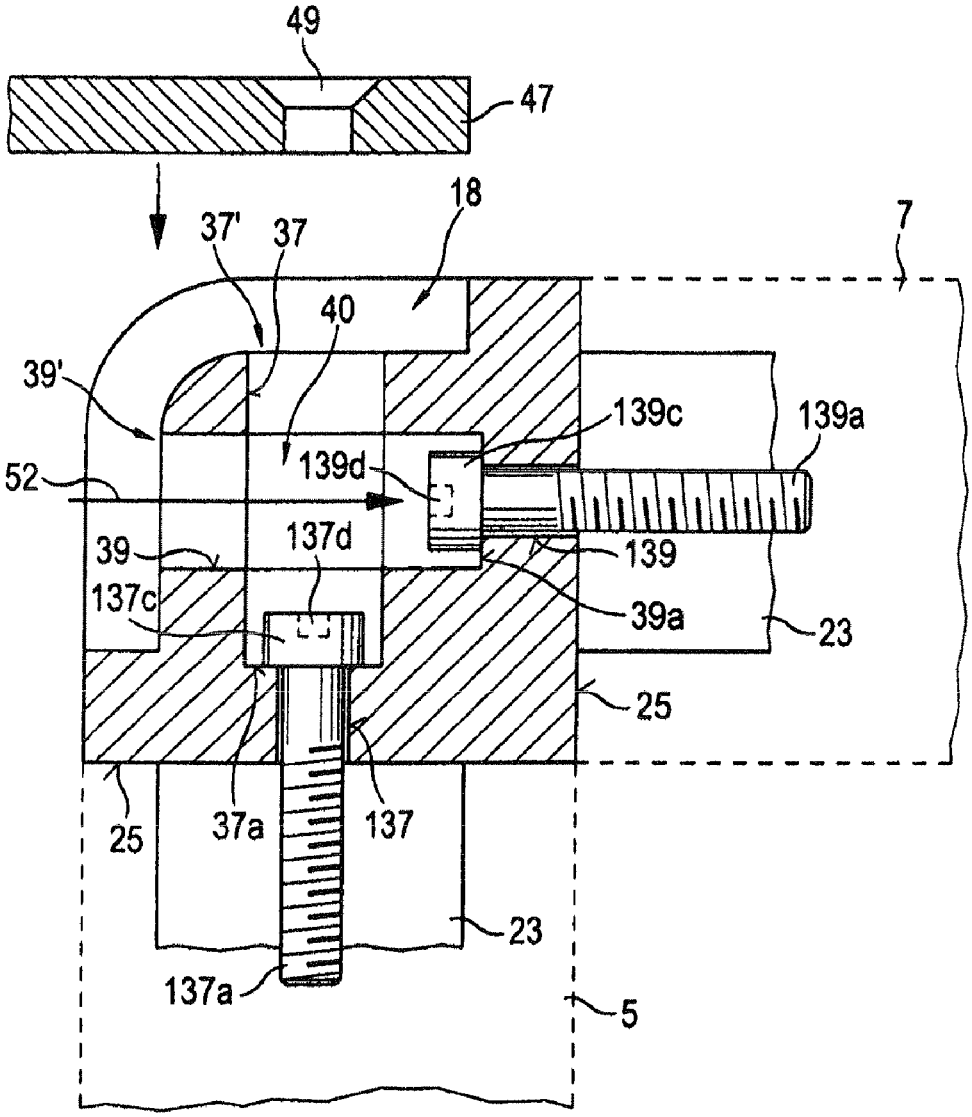
FIG. 6 is a sectional view along the plane of symmetry through the corner element, shown in FIG. 5, without an attached cover cap.

As shown by the cross-sectional illustration according to FIG. 6, the two axial holes 37 and 39 intersect in an intersection portion 40. In this respect, it can also be seen in particular from FIG. 6 that the two the axial hole 37, extending vertically in the illustrated embodiment, merges from its opening side 37' (i.e. below the intersection portion 40) downstream of the intersection portion 40 into a hole 137 which is narrowed with respect to the axial hole 37. Likewise, the further axial hole 39, extending in the horizontal direction, merges, seen from its opening or introduction side, downstream of or, in this embodiment, on the right after the intersection portion 40, into a hole 139 which aligns therewith and also has a smaller diameter than the axial hole 39.

This provides the opportunity, after a corner angle of this type has been driven into an adjoining lateral profiled part 5 or terminal or connecting profiled part 7 (indicated in dashed lines in each case in FIG. 6), to fix the corner angle by screwing in screws. For this purpose, FIG. 6 shows a vertical screw 137*a* and a horizontal screw 139*a*, the end of which extends into the respective lateral or terminal profiled part 5, 7 where it engages in the appropriately provided screw channel 17*a* (FIG. 3), thereby producing a rigid fixing with the lateral and terminal or connecting profiled parts 5, 7.

Since the vertically extending hole 37 merges downstream of the intersection point 40 into a narrowed hole 137 and the corresponding horizontally extending hole 39 merges downstream of the intersection point 40 into a hole portion 139 narrowed with respect thereto, an annular shoulder or a stop 37*a* and 39*a* is produced in each case at the transition to the narrowed hole, against which annular shoulder or stop 37*a* and 39*a* the screw head 137*c* and 139*c* of the associated fastening screw 137*a* and 139*a* strikes when the screw is tightened. In the secured position, the screw heads 137*c* and 139*c* are offset in each case from the intersection point 40, so that downstream of the intersection point 40, part of the axial length of the holes 37 and 39 is always free.

The mentioned cover cap 18 then seals off the inner structure of the corner angle in an aesthetically pleasing manner if a single wall element 1 is to be provided, as shown in FIG. 1.

If, for example, two wall elements 1 are to be interlinked and joined rigidly together in a direct straight extension, the corresponding cover cap (which can be used in the manner of a clip cap) has to be removed from the corner angle, so that the mentioned assembly opening 18 is exposed.

Figure 7:
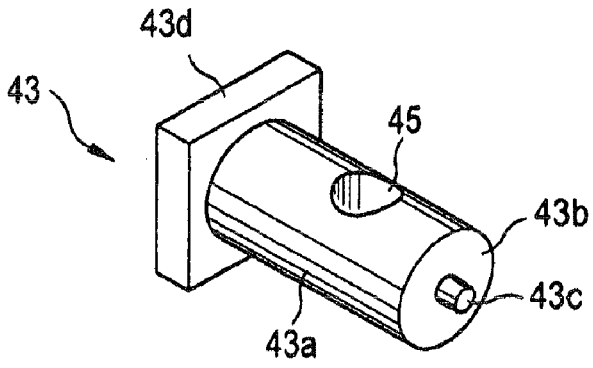
FIG. 7 is a schematic perspective view of an intermediate anchoring element which is used in connection with the corner element.

When interlinking with the next wall element in a straight extension from the previous wall element, the adjoining corner element of the next wall element is also prepared by removing the cover cap 19 such that a cylindrical intermediate anchoring element 43, shown in FIG. 7, can be inserted for the two corner elements in each case in a horizontal direction according to the arrow 52 via the axial hole 37. This intermediate anchoring element 43 with the cylindrical plug-in body 43*a* has a cross hole 45 in the cylindrical plug-in body 43*a*. In this case, this intermediate anchoring element 43 can be pushed into the axial hole 37 in the central body portion 21 of the corner element 9 until the cross hole 45 aligns with the vertical axial hole 37.

Figure 8:
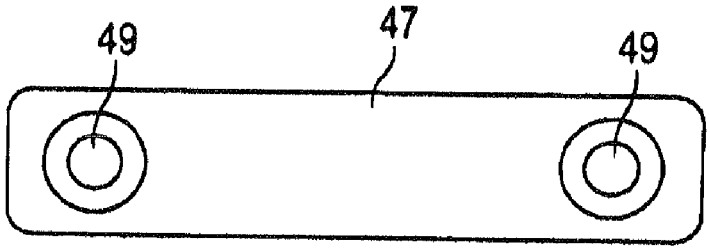
FIG. 8 is a schematic plan view of a straight linking element.

When the two adjoining corner elements of two wall elements to be interlinked have been prepared accordingly, they can be erected next to one another and a plate-shaped connection element 47, indicated in FIGS. 5 and 6 and shown in compact form in a plan view in FIG. 8, can be inserted in the manner of a connecting plate into the region of the upper portion of the assembly opening 18 such that it rests on the upper side of the central body portion 21 of the corner element 9. This connection element 47 also has holes 49 made therein which, when the connection element 47 has been accordingly correctly positioned, align with the axial hole 37, respectively located underneath, in the associated corner element 9. In this position, a screw 51 shown in FIG. 5 can be screwed in through the hole 49 in the connection element 47 and via the following axial hole 37 aligned therewith in the central body portion 21 of the corner element 9 down into the cross hole 45 in the intermediate anchoring element 43 (the respective screw head of screw 51 can also be seen in FIG. 2 in the assembled state).

Since the intermediate anchoring element 43 is held in the further horizontal axial hole 39 extending transversely to the vertical axial hole 37 in the central body portion 21 (which is an integral component of the corner element 9), and cannot be removed in the direction of the mentioned screw 51, a rigid anchoring of the connection element 47 on the corner element 9 is ensured.

The plate 47 is attached correspondingly to the adjacent corner element of the next wall element by its further hole 51, so that an interlinking is then ensured which continuously connects the two wall portions in an integrated manner.

At the same time, the connection element 47 covers the mentioned openings 31 in the corner elements 9 at the top.

To ensure a fixing construction which is as fixed and favourable as possible, the intermediate anchoring element 43 is provided on its end face 43*b*, leading in the plug-in direction, with an insertion nipple 43*c*. A corresponding central hole 137*d* and 139*d*, i.e. in particular a blind hole, is made in the screw head 137*a* of the screw 137 which is arranged in the immediate axial extension to the axial intermediate anchoring element 43 inserted into the horizontal axial hole 37. This makes it possible for the mentioned insertion nipple 43*c* to also engage in this blind hole 137*d* in the screw head 137*a* at the leading end face 43*b* of the intermediate anchoring element 43. Consequently, when fitted, the intermediate anchoring element 43 is held in an improved manner and is braced against arising forces. In this respect, it goes without saying that the external diameter of the plug-in portion 43*a* of the intermediate anchoring element 43 is adapted to the diameter of the axial hole 37, i.e. it is the same as the diameter or is only slightly smaller.

During assembly or disassembly of this intermediate anchoring element 43, to be able to optionally remove it again relatively easily, if required, it is provided in the insertion direction on the rear side with a rectangular end plate 43*d* which projects beyond the axial hole 37*a* in the intermediate body portion 21.

Figure 9:
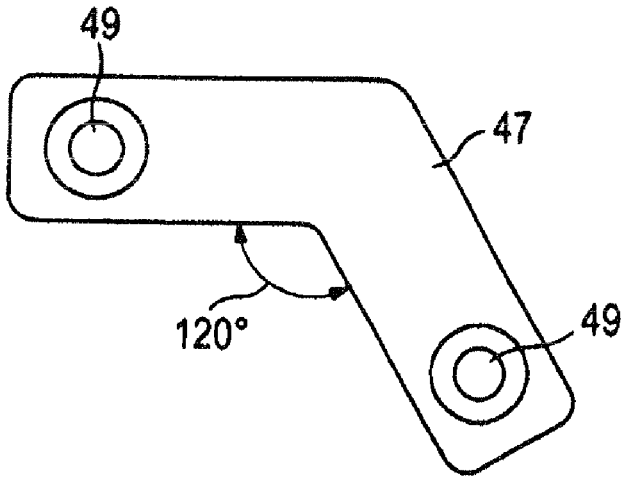
FIG. 9 is a plan view of a linking element for interlinking second partition walls at an angle of 120°.

If, for example, two wall elements are to be interlinked at an angle of 120°, for example a connection element 47, shown in FIG. 9, can be used which extends at a corresponding angle of 120°.

Figure 10:
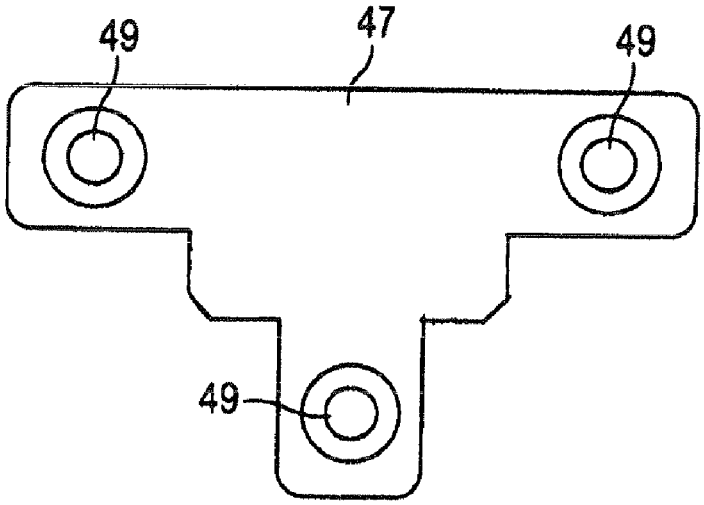
FIG. 10 is a plan view of a T-linking element for interlinking second wall elements standing adjacently in the longitudinal direction with a wall element aligned vertically thereto.

If, for example, three walls standing perpendicularly to one another are to be interlinked, i.e. two wall elements standing in immediate extension to one another with a wall element aligned perpendicularly thereto (for example, as shown in a schematic plan view in FIG. 2), a connection element 47 can be used which is shown in a schematic plan view in FIG. 10.

In other words, the most varied interlinking elements can be employed for the most varied interlinking situations.

The corresponding interlinking is preferably performed not only on the upper connecting or terminal profiled part 7 of such a wall module, but also in a corresponding manner on the underside in the corner regions of a wall module.

However, an interlinking can also be performed in the described manner, for example with a described wall module attachment element which also comprises an identically constructed modular frame. In this case, only one corresponding rectangular connection element 47, shown in FIGS. 5 and 6, would have to be attached to the corner module 9 on the left-hand lateral portion of the plug-in socket 17 extending in the vertical direction. In this case, the intermediate anchoring element 43 would be introduced through the vertically extending hole 37 in the central body portion 21 of the corner element 9, so that a corresponding fastening screw 51 can be screwed in through the horizontally extending hole 39 into the appropriately aligned tapped hole 45, (which is provided with a corresponding internal thread) in the intermediate anchoring element 43. Consequently, the plate would be held on its corresponding corner element then extending in a vertical direction. The upper part of the plate would be attached accordingly in the same way to the adjoining corner angle, as a result of which a wail module can be constructed against or on a lower wall module in a vertical extension.

The invention claimed is:

1. A partition wall comprising:

a wall module, including a modular frame, wherein the modular frame comprises at least two lateral side profiled parts which are offset in the horizontal direction, and at least one upper and lower connecting profiled part, between which a wall panel element is provided, a lateral profiled part and a connecting profiled part rigidly interconnected in corner regions of the partition wall using a corner element, the lateral profiled part and the connecting profiled part terminating at the corner element, wherein the corner element comprises two plug-in arms which are oriented at an angle to one another, one of the two plug-in arms being connected to the lateral profiled part and the other of the two plug-in arms being connected to the connecting profiled part, wherein the corner element comprises an intermediate body portion with the two plug-in arms, the one of the plug-in arms extending in the direction of the lateral profiled part and the other of the two plug-in arms extending in the direction of the connecting profiled part, wherein the corner element comprises a central body portion, wherein introduced into the central body portion are two holes from the outside in the axial direction of the respective plug-in arm, the two holes intersecting in an intersection portion, wherein an intermediate anchoring element introduced with a plug-in body into at least one of the two holes, wherein the intermediate anchoring element has a tapped hole which extends transversely to the axial direction of the plug-in body, wherein the intermediate anchoring element positioned in one of the two holes such that the tapped hole in the plug-in body aligns with the other of the two holes respectively in the central body portion, and wherein a fastening screw is screwed in through the one of the two holes aligning with the tapped hole in the intermediate anchoring element, by which fastening screw a connection element producing a connection with a next wall element to be interlinked is anchored.

2. A partition wall according to claim 1, wherein in an axial extension of the holes downstream of the intersection portion, a respective screw projects through into respective arm holes passing through the associated plug-in arm in its axial extent and is screwed into an adjoining anchoring portion of the lateral and/or connecting profiled part, as a result of which the corner element is rigidly connected in an adjoining one of the lateral or connecting profiled part.

3. A partition wall according to claim 2, wherein the screw is screwed with its free end into a screw channel in the adjoining lateral or connecting profiled part.

4. A partition wall according to claim 2, wherein the arm hole passing through the respective arm has a smaller diameter than the hole one of the two holes which aligns axially therewith and passes through the central body portion.

5. A partition wall according to claim 4, wherein the fastening screws have a screw head which is supported at the transition from the two holes into the arm holes narrowed relative thereto, on a stop formed thereby.

6. A partition wall according to claim 1, wherein the plug-in body of the intermediate anchoring element has on its end face leading in the insertion direction a projecting introduction nipple which engages in a corresponding screw hole in the screw head adjoining in the axial direction, of the fastening screws.

7. A partition wall according to claim 1, wherein the intermediate anchoring element has a cylindrical plug-in body.

8. A partition wall according to claim 1, wherein the intermediate anchoring element has on its side trailing in the insertion direction a portion which projects over the respective one of the two holes.

9. A partition wall according to claim 1, wherein the connection element for interlinking at least two wall elements to be erected adjacently is plate-shaped.

10. A partition wall according to claim 9, wherein the connection element is rectangular.

11. A partition wall according to claim 9, wherein the plate-shaped connection element comprises two arm portions which are oriented at an angle to one another, a mutual angular position of which determines an angular position of two adjacent items of partition walls which are to be interlinked.

12. A partition wall according to claim 9, wherein the plate-shaped connection element is T-shaped for interlinking three partition walls or is cruciform for interlinking four partition walls.

13. A partition wall according to claim 1, wherein two partition walls to be interlinked next to one another can be interlinked by an upper corner element and a lower corner element to the connection element.

14. A partition wall according to claim 1, wherein, on a wall panel, it is configured to construct and assemble a further wall panel attachment, the plug-in body of the intermediate anchoring element being inserted into one of the two holes that is vertically extending in the central body portion of the corner element, and wherein the fastening screw is screwed into the tapped hole in the intermediate anchoring element through one of the hole that is horizontal hole, by which the connection element is secured which extends in a vertical direction to a wall panel attachment which can be built on above the partition wall, for fixing thereof.

15. A partition wall with top and side parts and a corner connector between the top and side parts, the connector having two plug-in arms in the top and side parts, a central body portion with two holes intersecting a portion, an anchoring element with a plug-in body in at least one of the holes, the anchoring element having a tapped hole extending transversely axially with the plug-in body and being positioned so the plug-in body aligns with the other of the two holes in the central body portion and a screw through the hole aligned with the tapped hole to make a connection with a next wall.

* * * * *